United States Patent [19]

Seifert et al.

[11] Patent Number: 4,531,676

[45] Date of Patent: Jul. 30, 1985

[54] FUEL INJECTION NOZZLE FOR INTERNAL COMBUSTION ENGINES

[75] Inventors: Kurt Seifert, Esslingen-Zollberg; Karl Hofmann, Remseck, both of Fed. Rep. of Germany

[73] Assignee: Robert Bosch GmbH, Stuttgart, Fed. Rep. of Germany

[21] Appl. No.: 421,196

[22] Filed: Sep. 22, 1982

[30] Foreign Application Priority Data

Jan. 26, 1982 [DE] Fed. Rep. of Germany ..... 3202364
May 29, 1982 [DE] Fed. Rep. of Germany ..... 3220398

[51] Int. Cl.[3] ..... F02M 61/08; F02M 61/16

[52] U.S. Cl. ..... 239/453; 239/533.3; 239/533.12

[58] Field of Search ..... 239/533.2–533.12, 239/453

[56] References Cited

U.S. PATENT DOCUMENTS 4,417,693 11/1983 Fussner et al. ..... 239/533.9

FOREIGN PATENT DOCUMENTS 1542846 3/1979 United Kingdom ..... 239/533.9
2093118 8/1982 United Kingdom ..... 239/533.9

*Primary Examiner*—Andres Kashnikow
*Attorney, Agent, or Firm*—Edwin E. Greigg

[57] ABSTRACT

A fuel injection nozzle for internal combustion engines, having a valve needle arranged to open toward the outside and said valve needle further connected with a piston which defines a fuel-filled damping chamber, which communicates with the flow path of the fuel only via a throttle conduit during the opening stroke of the valve needle. The damping chamber is formed in a cap which is placed onto the piston. As a result, jamming of the elements in the radial direction is avoided. Furthermore, the piston may be embodied by the valve needle per se, resulting in a simple and space-saving construction. By means of the appropriate embodiment and supporting of the cap, the damping effect can be limited dependent on the stroke and/or the travel speed of the valve needle.

10 Claims, 7 Drawing Figures

FUEL INJECTION NOZZLE FOR INTERNAL COMBUSTION ENGINES

BACKGROUND OF THE INVENTION

The invention is based on a fuel injection nozzle for internal combustion engines having a valve needle stressed by a closing spring and opening in the flow direction of the fuel, the valve needle being connected with a piston which defines a damping chamber filled with fuel, which damping chamber communicates only via a throttle conduit with the flow path of the fuel during the opening stroke of the valve needle. In such injection nozzles, the opening movement of the valve needle is delayed or damped, at least over a portion of its stroke, in that the fuel is capable of flowing into the damping chamber or exiting from this chamber only in a throttled manner; the damping chamber at such a time is becoming larger or smaller. During the closing stroke of the valve needle, care must be taken that the valve needle is capable of returning rapidly to its closed position without being hindered by the damping means. In a known injection nozzle of this general type (German patent application 31 20 060), this is attained in that the piston is coupled with a valve needle via a drag connection, and this connection is interrupted during the return stroke of the valve needle, permitting the piston to return to its outset position under the influence of its own restoring spring. The damping chamber is embodied by a blind bore in the nozzle holder in which the piston is displaceably supported with a clearly-defined radial play. In this embodiment the piston represents an added part, and its return spring requires additional space in the axial direction of the injection nozzle. The drag connection between the valve needle and the piston requires a sufficiently large amount of radial play so that the piston will not stick against the bore wall of the nozzle holder and hinder satisfactory operation of the valve needle. Attaching the drag connection is furthermore associated with wear.

OBJECT AND SUMMARY OF THE INVENTION

The apparatus according to the invention has the advantage over the prior art that the cap forming the damping chamber is centered directly on the piston in the radial direction, so that a sufficiently large radial play is provided between the cap and the walls of the nozzle holder surrounding it, and jamming of the elements can thereby be reliably avoided. The piston can therefore be connected in one piece at least with the support disk serving to engage the closing spring, or if a supplementary damping effected by the forces of mass is not desired, then the piston is preferably also embodied by the valve needle itself or by the end portion thereof remote from the injection port. In either case, a separate part is not required for forming the piston, and a drag connection between the valve needle and the piston can also be eliminated. By means of the cap which is integrated within the volume of the pressure chamber, a volumetric compression caused by piston action which would influence the supply flow of fuel is avoided.

A particularly simple realization is attained if the cap in its entirety is pressed by a restoring spring against the end of the piston. Upon the return stroke of the valve needle, the entire cap is pressed back by the piston via the fuel cushion in the damping chamber; the restoring spring acting upon the cap thereupon positively displaces the quantity of fuel which had flowed into the damping chamber during the opening stroke back out of the damping chamber. This process can last until the beginning of the next opening stroke of the valve needle, so that the restoring spring acting upon the cap may be correspondingly weak in dimension.

A realization which hardly restricts the closing force during the return stroke of the valve needle is attained if the wall section of the cap which can be deflected counter to the spring force forms a valve body, which is displaceable outward, opening the damping chamber, relative to a rigid wall section having the valve opening. The valve body may preferably be embodied by the entire bottom of the cap, which is elastically deflectable with respect to the annular jacket portion of the cap.

The throttle conduit leading into the damping chamber may be embodied, in the simplest case, by the radial play between the piston and the overlapping portion of the cap. A realization which is less sensitive to becoming soiled is attained if the cap includes a throttle bore discharging into the damping chamber, the throttle bore being provided by way of example in the bottom of the cap.

For the sake of limiting the damped portion of the stroke of the valve needle, the cap may advantageously have at least one radial slit of a predetermined depth in its jacket portion. The magnitude of the axial overlapping of the radial slit or slits by the piston in the closing position of the valve needle then determines the length of the damped portion of the stroke upon opening of the needle. This control function can also be assumed by a transverse bore in the cap. The radial slit in that case assures only the unthrottled flow of fuel through the pressure chamber.

It is particularly advantageous if the cap is supported, toward the injection opening, via a prestressed support spring on the housing. By appropriately adapting the support spring to the damping coefficient, the damping can be limited in a pressure-dependent manner. This is desirable in some cases in the high rpm range of the engine, in order that the restoring spring will be able to return the cap back to its outset position by the beginning of the next injection process.

In an apparatus having a support spring, the assembly of the elements is made easier if the restoring spring for the cap engages a cage which is displaceably supported between two stops attached to the housing and in which the cap and the support spring are held.

Another possibility for limiting the damping effect in accordance with pressure is described, in which the cap is provided with a throttle valve opening toward the damping chamber; the throttle valve is controlled by the difference between the fuel pressures outside and inside the damping chamber.

A more compact realization of the injection nozzle is attained if the cap is provided with a flange, which is engaged by the restoring spring of the cap, here embodied as a helical spring. In that case, the restoring spring extends over the cap and a portion of the piston, so that space in the axial direction of the injection nozzle is not required for this portion of the restoring spring.

A particularly simple embodiment is attained if the piston is connected in one piece with the valve needle or is embodied by the valve needle itself. In some cases, however, it may also be efficacious to connect the piston in one piece with a support member for the closing spring of the valve needle.

The invention will be better understood and further objects and advantages thereof will become more apparent from the ensuing detailed description of seven preferred embodiments taken in conjunction with the drawings.

DESCRIPTION OF THE PREFERRED EMBODIMENTS

Figure 1:
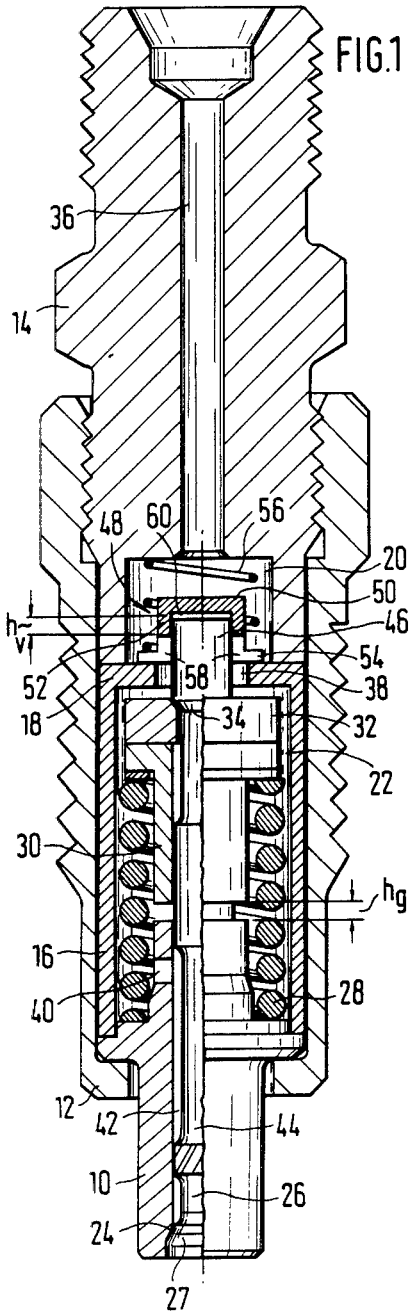
FIG. 1 shows a cross-sectional view of an injection nozzle in accordance with the first exemplary embodiment of the invention, seen in longitudinal section.

The injection nozzle of FIG. 1 has a nozzle body 10, which is firmly clamped to a nozzle holder 14 by a sleeve nut 12. A sheath 16 is disposed between the nozzle body 10 and the nozzle holder 14, and the sheath 16 has an inwardly directed shoulder 18 which divides a chamber 20 from a chamber 22 of larger diameter in the interior of the injection nozzle. A valve seat 24 is formed in the nozzle body 10, and a valve needle 26 which is displaceably disposed, has its sealing cone 27 pressed by a closing spring 28 against the valve seat 24. The closing spring 28 is supported on the nozzle body 10 and via a flange element 30 engages a support disk 32, which is supported in turn on a shoulder 34 of the valve needle 26.

An inlet bore 36 is formed in the nozzle holder 14 and discharges into the chamber 20 which communicates via an aperture 38 surrounding the shoulder 18 with the chamber 22. A bore 40 in the nozzle body leads out of the chamber 22 into an annular chamber 42, which is formed between the central bore wall of the nozzle body 10 and the jacket circumference of a section 44 of smaller diameter of the valve needle 26 and extends to a point just before the valve seat 24. A distance $h_g$ exists between the flange element 30 and the nozzle body 10 in the illustrated closing position, this distance corresponding to the total stroke of the valve needle 26. The valve needle 26 is displaced outward, in the opening direction, by the fuel pressure counter to the force of the closing spring 28 until the flange element 30 strikes against the nozzle body 10. Upon the closure of the valve, the closing spring 28 returns the valve needle 26 back inward, into the illustrated closed position.

A piston-like extension 46 which is integral with the shoulder 34 of the valve needle 26, passes through the aperture 38 and protrudes into the chamber 20. The diameter of the piston-like extension 46 corresponds to the guide diameter of the valve needle 26. A cap 48 is placed upon the extension 46 and has a bottom 50, a jacket portion 52, and a flanged rim 54. The cap 48 is engaged by a restoring spring 56, which surrounds the jacket portion 52 and presses the flange rim 54 against the shoulder 18 of the sheath 16.

Transverse slits 58 are provided in the flanged rim 54 and a region adjacent thereto of the jacket portion 52 of the cap 48, and when the valve needle 26 is opened the fuel can flow through these transverse slits 58 out of the chamber 20 into the chamber 22. In the illustrated closed position of the valve needle 26, a damping chamber 60 is formed between the end face of the extension 46 and the inner bottom wall 50 of the cap 48, the damping chamber communicating in a throttled manner, via the radial play between the extension 46 and the jacket portion 52 of the cap 48, with the flow path of the fuel. In the illustrated closed position, the extension 46 overlaps the transverse slits 58 and the cap 48 in the axial direction by the distance $h_v$, which corresponds to the damped pre-stroke of the valve needle 26 to be described below.

The illustrated injection nozzle functions as follows:

The increasing fuel pressure at the onset of an injection procedure creates a pressure difference between the throttled damping chamber 60 and the chamber 20, because the cap 48 is not capable of following the movement of the valve needle 26. The pressure increase in the damping chamber 60 and thus on the end face of the extension 46 or of the valve needle 26 is effected more slowly than in the chamber 20, so that the movement of the valve needle 26 is delayed or damped until the valve needle 26 has traveled the distance $h_v$ and the end face of the extension 46 arrives in the vicinity of the transverse slits 58. From then on, the remaining stroke of the valve needle is effected in an undamped manner until the flange element 30 strikes the nozzle body 10.

During the first stroke portion $h_v$, fuel is expressed into the damping chamber 60 by the radial play existing between the extension 46 and the jacket portion 52 of the cap 48. During the closing movement of the valve needle 26, the cap 48 is carried along upward as well via the cushion of fuel that has flowed into the damping chamber 60; the restoring spring 56 is then capable of exerting only a relatively slight resistance to the substantially stronger closing spring 28. The restoring spring 56 is dimensioned such that the quantity of fuel that has flowed into the damping chamber 60 is positively displaced out of the damping chamber 60, except for a remnant volume, between the beginning of the closing stroke of the valve needle 26 and the beginning of the next opening stroke, and the cap 48 has again come to rest on the shoulder 18.

The cap 48 is centered on the valve needle 26 and otherwise has a sufficiently large radial play with respect to the nozzle holder 14, so that the valve needle 26 can operate without jamming. The restoring spring 56 for the cap 48 extends partway over the cap 48, so that in this construction the means for partial damping of the opening stroke of the valve needle 26 require little space in the axial direction of the injection nozzle.

Figure 2:
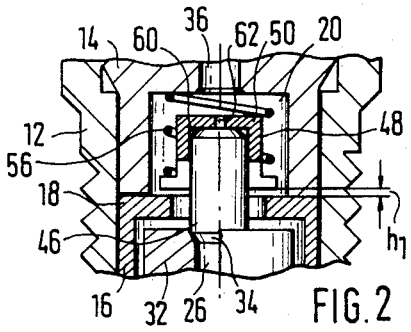
FIGS. 2–7 show the other exemplary embodiments, each being illustrated by a fragmentary cross-sectional view taken through a portion of the apparatus of particular pertinence.

The injection nozzle of FIG. 2 agrees substantially with the injection nozzle of FIG. 1 described above, so that identical elements will also be identified by the same reference numerals. However, the cap 48 is provided with a throttle bore 62 in its bottom 50, with which throttle bore 62 the effectiveness of the piston damping is affected. The extension 46 of the valve needle 26 is also extended upward as compared with the design shown in FIG. 1, it being so long that the cap 48 can no longer be seated on the shoulder 18, but instead is at a distance $h_l$ from the shoulder 18 in the closing position of the valve needle 26. As a result it is attained that the means for damping the valve needle movement come into effect only after a pre-stroke of the dimension $h_l$ has been executed, which in some cases may be advantageous. The upper end of the extension 46 of the valve needle 26 is rounded in embodiment, because here the cap 48 is supported, in the illustrated outset position, directly on top of the valve needle 26 or on its extension 46, and the rounded contour makes it easier to positively displace the fuel from the damping chamber 60.

Figure 3:
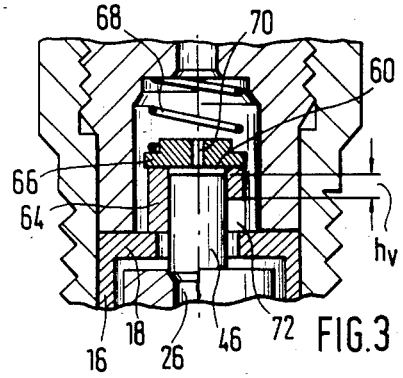

In the exemplary embodiments of FIGS. 1 and 2, the cap 48 represents a rigid, integral element, which is moved in its entirety back and forth by the valve needle 26 and the restoring spring 56. In the injection nozzle shown in FIG. 3, instead of a one-piece cap, a combination of an annular body 64 and a flat valve body 66 is provided, which is pressed by a closing spring 68 against the upper end face of the annular body 64. The annular body 64, in the illustrated closing position of the valve needle 26, is supported on the shoulder 18 of the sheath 16 and is dimensioned such that in this position a small remnant volume of the damping chamber 60 remains. Upon the movement of the valve needle 26 in the opening direction, fuel is positively displaced into the damping chamber 60 via a throttle bore 70 in the valve body 66.

The desired, damped pressure increase exerted upon the end face of the extension 46 of the valve needle 26 is thereby generated. Once the valve needle 26 has executed the stroke portion $h_v$, the end face of the extension 46 enters the region of a transverse slit 72 of the annular body 64, whereupon the damping is eliminated. Upon the return stroke of the valve needle 26, the valve body 66 lifts away from the annular body 64, so that the fuel previously displaced into the damping chamber can exit from the damping chamber 60 once again, except for the remnant volume.

Figure 4:
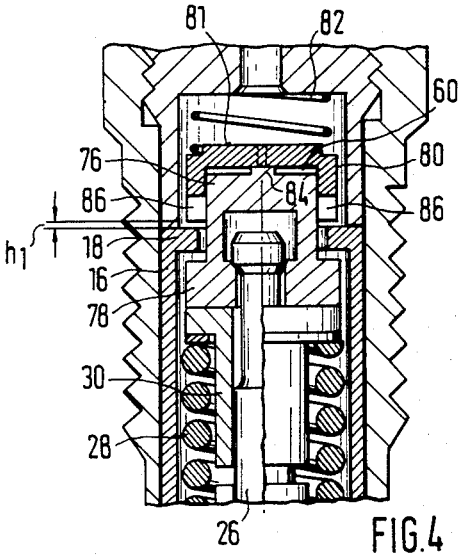

In the injection nozzle of FIG. 4 a damping piston 76 is provided, which has a pedestal 78 serving as a support member for the closing spring 28. A cap 80 is placed onto the damping piston 76, its bottom 81 being pressed by a restoring spring 82 against a central extension 84 of the damping piston 76. The cap 80 is likewise provided with transverse slits 86 and is realized with a length such that in the illustrated closing position of the valve needle it is at a distance $h_l$ from the shoulder 18 of the sheath 16. The processes of opening and closing of the valve take place in the same manner as in the above-described exemplary embodiments. Embodying the damping piston 76 as a separate part from the valve needle 26 has the advantage that the diameter of the damping piston 76 can be selected as larger than that of the valve needle 26, so that the damping effect can also be influenced in the desired manner.

In all four exemplary embodiments described above, the damping chamber 60 could be opened toward the pressure chamber 20 by means of one or more additional bores in the cap 48, 80 or in the annular body 64, instead of by way of the transverse slits 58, 72, 86.

Figure 5:
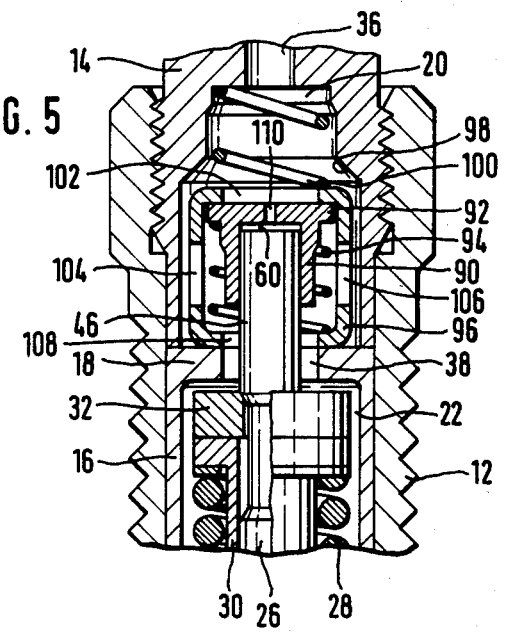

In the injection nozzle of FIG. 5, a cap 90 is placed onto the extension 46 of the valve needle 26, the cap 90 having a flanged rim 92 at its upper end which is engaged by a support spring 94. The cap 90 and the support spring 94 are held in a cage 96, which is displaceably supported with a notable amount of radial play in the chamber 20 between a shoulder 98 of the nozzle holder 14 and the shoulder 18 of the sheath 16. A restoring spring 100 acts upon the cage 96, forcing the cage 96 toward the shoulder 18. The cage 96 is provided with apertures 102, 104, 116, 108 in its wall, through which the fuel flows out of the chamber 20 into the aperture 38 and the chamber 22. As in the above-described embodiments, the damping chamber 60 is provided in the cap 90, communicating via a throttle bore 110 with the chamber 20.

The injection nozzle according to FIG. 5 functions as follows:

At the beginning of an injection procedure, the elements assume the position shown in FIG. 5, in which the cage 96 is resting on the shoulder 18. With increasing fuel pressure, a pressure difference between the damping chamber 60 and the chamber 20 is created, the cap 90 under the influence of the support spring 94 cannot at first follow the movement of the valve needle 26, and the fuel passes via the narrow throttle bore 110 into the damping chamber 60 in a delayed fashion. The pressure difference is the greater, the more rapidly the valve needle 26 moves in the opening direction. The support spring 96 is designed such that in idling and at a medium rpm range of the engine, the pressure difference is not capable of overcoming the pre-stressing of the support spring 94, so that the damping is effective over the entire needle stroke. If needed, the cap 90 could be provided with slits, similarly to the realization of FIG. 1, so that with a long needle stroke, a stroke-dependent limitation of the damping is produced.

In the upper rpm range of the engine, the pressure difference between the chamber 20 and the damping chamber 60 increases to such an extent that the pre-stressing force of the support spring 94 is overcome. The cap 90 then follows the valve needle 26, the support spring 94 becoming compressed; as a result the damping effect is no longer amplified. By appropriate selection or adjustment of the support spring 94, the damping effect can be limited in accordance with pressure to a desired extent. Upon the closing stroke of the valve needle 26, at first the entire cage 96 together with the cap 90 and support spring 94 is deflected upward, the restoring spring 100 becoming compressed. The restoring spring 100 is dimensioned such that it expresses the fuel which has flowed into the damping chamber 60 from the beginning of the closing stroke of the valve needle 26 to the beginning of the next opening stroke back out of the damping chamber 60 except for the remnant volume corresponding to the illustrated outset position, and has returned the cage 96 back to where it rests on the shoulder 18.

Figure 6:
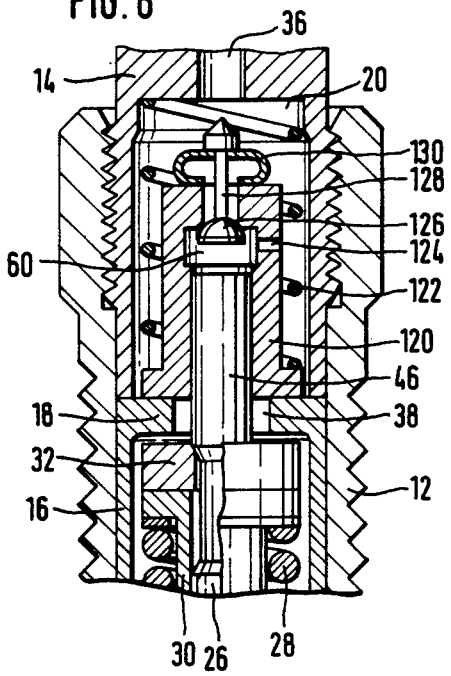

In the injection nozzle shown in FIG. 6, a cap 120 is placed onto the extension 46 of the valve needle 26, the cap 120 being pressed toward the shoulder 18 of the sheath 16 by a restoring spring 122. A damping chamber 60 is again provided in the cap 120, communicating via a throttle bore 124 and additionally via a throttle valve 126 opening toward the damping chamber 60 with the chamber 20. The throttle valve 126 has a closing member 128, which is pressed against its seat by means of a leaf spring 130 disposed outside the damping chamber 60. The leaf spring 130 is dimensioned and pre-stressed such that the throttle valve 126 opens at a predetermined pressure difference and limits the damping effect to a predetermined value. Upon the closing stroke of the valve needle 26, the throttle valve 126 is closed; the cap 120 again is deflected temporarily upward, as in the constructions shown in FIGS. 1–4, so that the closing stroke of the valve needle 26 is either unhindered by the escape of fuel from the damping chamber 60 or is not substantially hindered thereby.

Figure 7:
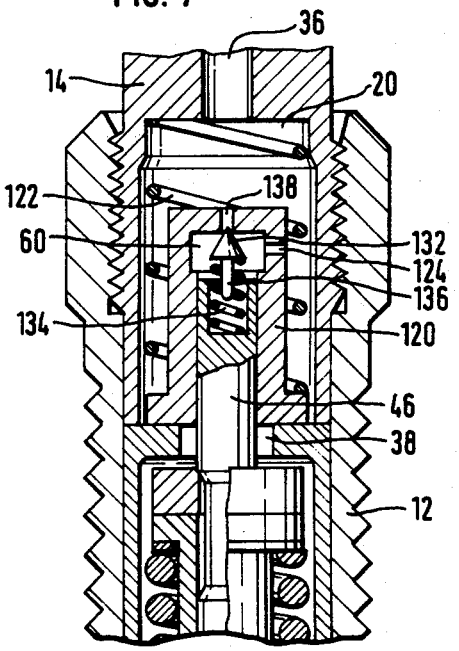

The injection nozzle of FIG. 7 functions like that of FIG. 6; however, a throttle valve 132 is provided here, the closing spring 134 of which, embodied as a helical spring, is disposed in the interior of the cap 120. The throttle valve 132 has a closing member 136, which closes a relatively small bore 138 in the bottom of the cap 120, so that the closing spring 134 may be very small in size, and can be accommodated in a blind bore in the extension 46.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines provided with a valve needle stressed by a closing spring and arranged to open in a fuel flow direction, said valve needle further being connected with a piston associated with a damping chamber filled with fuel, said damping chamber arranged to communicate and expand only via a throttle conduit with a flow path of the fuel during an opening stroke of the valve needle, characterized in that said damping chamber is provided by a cap mounted on said piston, said cap further being supported at least after a pre-stroke ($h_1$) of said piston in an injection direction, said cap further having a wall section movable in an opposite direction thereto counter to the force of a restoring spring, said piston having an end face and said cap being urged toward said end face of said piston by said restoring spring, and said movable wall section defining a bottom portion of said cap.

2. An injection nozzle as defined by claim 1, characterized in that said movable wall section of said cap forms a valve body having a valve opening, said valve body further having a portion which is arranged to be displaced outwardly thereby opening said damping chamber.

3. An injection nozzle as defined by claim 1, characterized in that said cap further includes an annular jacket portion and that said bottom of said cap can be lifted from said jacket portion counter to spring force.

4. An injection nozzle as defined by claim 1, characterized in that said cap has at least one radial slit of predetermined depth in said jacket portion.

5. An injection nozzle as defined by claim 1, characterized in that said cap is supported on a means via a pre-stressed support spring.

6. An injection nozzle as defined by claim 5, characterized in that said cap is enshrouded by a cage means, said cage means displaceably supported between two stop means, and further wherein said pre-stressed support spring is held in said cage means.

7. An injection nozzle as defined by claim 1, characterized in that said cap further includes a throttle valve arranged to open toward said damping chamber and said throttle valve further controlled by the pressure differences existing between the fuel inside and outside of said damping chamber.

8. An injection nozzle as defined by claim 1, characterized in that said cap further includes a flange, which is engaged by said restoring spring and said restoring spring is helical.

9. An injection nozzle as defined by claim 1, characterized in that said piston is integral with said valve needle.

10. An injection nozzle as defined by claim 1, characterized in that said piston is associated with a support member and said support member adapted to receive the force of said closing spring of said valve needle.

* * * * *